United States Patent [19]

Rukawina

[11] 4,244,066

[45] Jan. 13, 1981

[54] MATTRESS ASSEMBLY

[76] Inventor: Emma Rukawina, 161 E. 89th St., New York, N.Y. 10028

[21] Appl. No.: 51,946

[22] Filed: Jun. 25, 1979

[51] Int. Cl.[3] ..... A61G 7/02; A47G 9/02

[52] U.S. Cl. ..... 5/463; 4/450; 5/484; 5/496

[58] Field of Search ..... 5/90, 463, 495, 496, 5/498, 499, 484; 4/112, 113

[56] References Cited

U.S. PATENT DOCUMENTS

| | | | |
|---|---|---|---|
| 566,657 | 8/1896 | Carpenter | 5/90 |
| 1,302,915 | 5/1919 | Gossard | 5/463 |
| 4,011,610 | 3/1977 | Parker | 5/463 |
| 4,096,594 | 6/1978 | St. Jean | 5/463 |
| 4,122,565 | 10/1978 | Hoben | 5/463 |

*Primary Examiner*—Roy D. Frazier
*Assistant Examiner*—Alexander Grosz
*Attorney, Agent, or Firm*—Bernard Malina

[57] ABSTRACT

A mattress includes a recess for receivably seating a single-use receptacle having a screened opening for receiving fluids and wastes from the body of a bed patient. The sheet wrapping the mattress has an opening in registry with the receptacle opening. The receptacle, when filled with fluids, is removable by sliding the same through a slot in the mattress which extends from the mattress recess to one side thereof thereby avoiding the necessity of moving the patient. A fresh receptacle is similarly inserted into the mattress.

7 Claims, 6 Drawing Figures

FIG. 1
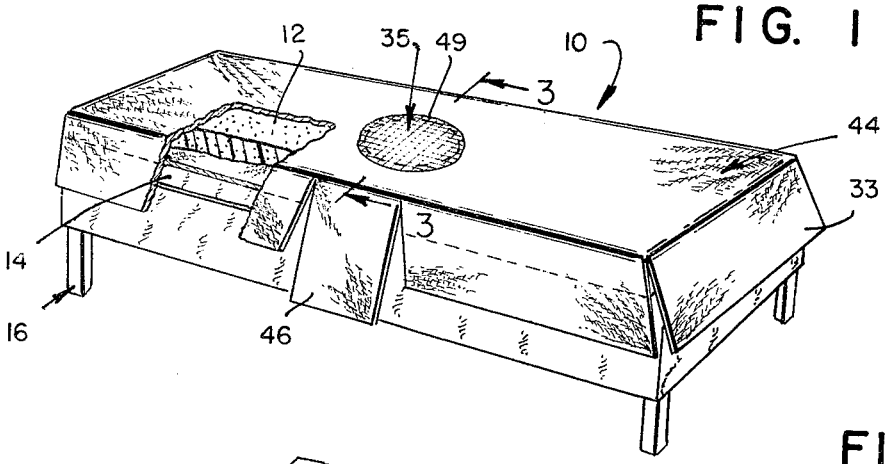
FIG. 2
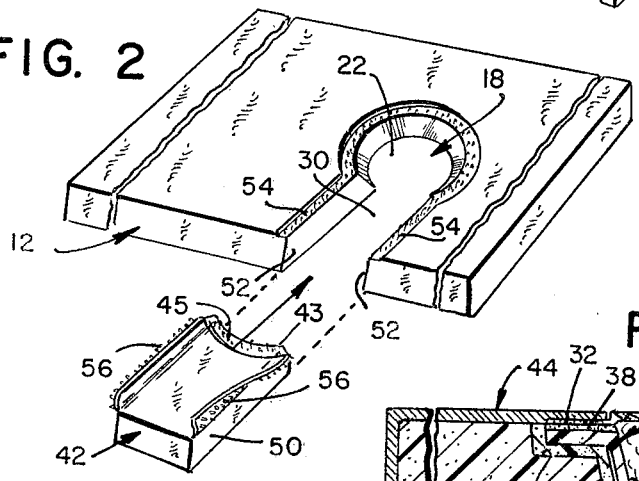
FIG. 5
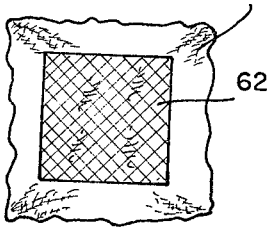
FIG. 3
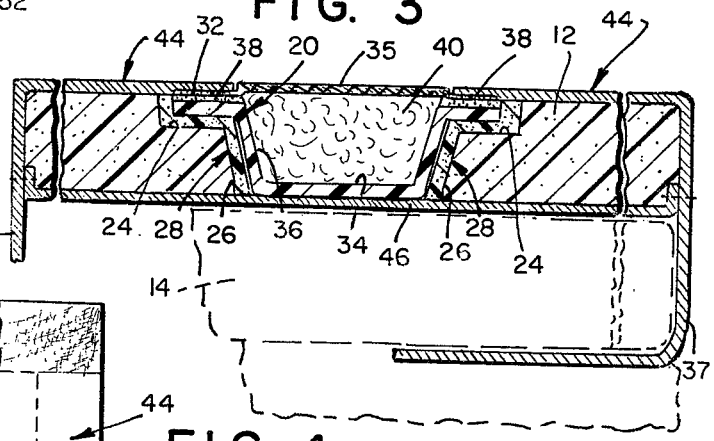
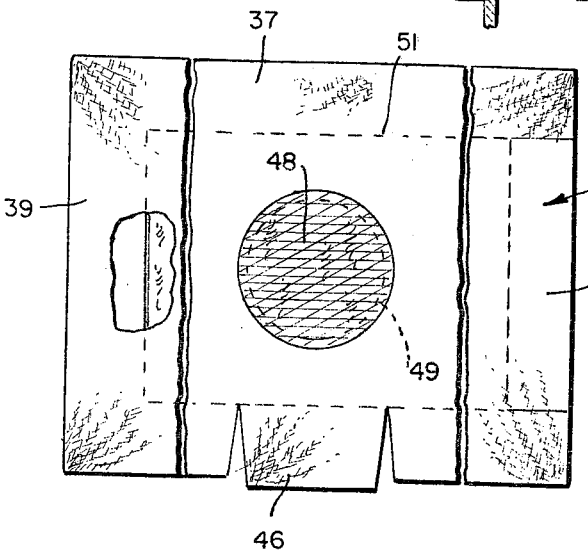
FIG. 4
FIG. 6
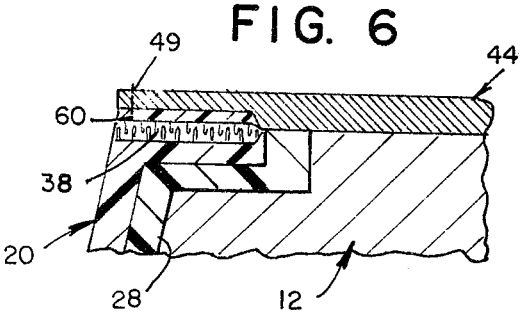

MATTRESS ASSEMBLY

BACKGROUND OF THE INVENTION

The present invention relates to mattresses and more particularly to mattress assembly for invalids and incontinent persons.

Hospital patients, nursing home residents, and others who suffer from incontinency require that their bed linens require changing, sometimes several times a day. Furthermore, in many cases the required bed pans cannot be provided promptly. In the case of incontinent persons, the soiling of the bed linens is generally caused by uncontrolled or involuntary discharge of urine. Hospital patients and nursing home residents are generally administered at least one and in some cases several bed baths a day. This procedure is employed where it is difficult or inadvisable to remove the patient from the bed for conventional bathing purposes.

In all such cases, the bed linens are wetted either as a result of discharge of urine or by the washing of the patient while lying in the bed. Particularly when the patient is infirm, his removal from the bed in order to change the bed linens requires the efforts of at least two and possibly more persons such as nurses or attendants.

It is, therefore, a primary object of the present invention to provide a mattress assembly which permits washing of a patient in his bed without wetting the bed linens.

It is another object of the present invention to provide a mattress assembly which provides drainage of fluid from a patient's body with a minimum of soilage of the bed linens.

It is a further object of the present invention to provide a mattress assembly of the character described in which the drained fluid may be collected and removed without disturbing the patient in his bed.

It is yet another object of the present invention to provide a mattress assembly of the character described in which the means for collecting the drained fluid is inexpensive in manufacture and hence is disposable.

SUMMARY OF THE INVENTION

In accordance with the principles of the present invention there is provided a mattress assembly comprising a receptacle having a top opening for receiving fluids from the body of a bed occupant and a mattress having a recess for receiving the receptacle therein. Also provided is a sheet for wrapping the mattress, the sheet having an opening therein for registry with the top opening of the receptacle to permit the flow of fluids through the sheet opening into the receptacle.

Further objects, features and advantages of the present invention will become more apparent from a consideration of the following detailed description when taken in conjunction with the accompanying drawings, in which:

BRIEF DESCRIPTION OF THE DRAWINGS

FIG. 1 is a front perspective view showing the mattress assembly of the present invention on a bed;

FIG. 2 is a top perspective view of the foam mattress slab of the mattress assembly with the side insert removed;

FIG. 3 is a section view taken along the line 3—3 in FIG. 1, with the double sheet in folded condition;

FIG. 4 is a top view of the bed sheet forming part of the mattress assembly of the present invention;

FIG. 5 is a top view of a bowl forming part of the mattress assembly of the present invention in another embodiment thereof; and FIG. 6 is a section view of the border of a sheet forming part of the mattress assembly in a further embodiment thereof.

DETAILED DESCRIPTION OF THE INVENTION

Referring to the drawings, the mattress assembly of the present invention designated by the numeral 10 includes a generally rectangular mattress preferably in the form of a foam slab 12 dimensioned to overlie the conventional mattress 14 in an ordinary bed 16.

Approximately mid-length thereof, a through cut-out 18 is provided in mattress 12 for receiving a drainage receptacle in the form of a circular bowl 20. Cut-out 18 includes a circular cut-out portion 22 positioned longitudinally along the length of mattress 12 to correspond to the pelvic area of the patient when lyiny on mattress 12. As best shown in FIGS. 2 and 3, circular cut-out portion 22 may comprise a recessed shoulder 24 and a tapered inwardly sloping sidewall 26 to which is secured a conforming liner 28 which may be made of semi-rigid foam or plastic material to provide some degree of stability to bowl 20 seated therein.

Extending laterally to one side from circular cut-out portion 22 is a generally rectangular cut-out portion 30 which extends to one side of mattress 12.

In one embodiment of the present invention, drainage bowl 20 is of generally circular configuration having a lip 32, a flat annular bottom wall 34, and an inwardly sloping sidewall 36 joining lip 32 and bottom wall 34. Bowl 30 which may advantageously be made of soft-bendable plastic material, includes a circular screen 35 of soft fibrous material, overlying the top opening of bowl 30 and peripherally secured to the inner portion of lip 32 adjacent the top edge of bowl sidewall.

An annular strip of fibrous gripping material 38, such as that sold under the trademark Velcro, is secured to the remaining top surface of bowl lip 32, with the gripping surface facing upwardly. Located within bowl 20 is cellulose type fluid absorbing material 40 similar to that used in currently available disposable diapers in order to prevent spillage.

Mattress 12 includes a removable generally rectangular insert 42 having circular front wall 43, the removal of which permits bowl 20 to be slideably removed from its seated position in liner 28. Front wall 43 is provided with a shoulder portion 45 and is shaped similarly to sidewall 26 so that in the assembled position it completes the circular cut-out 22 for seating bowl 20.

The mattress assembly 10 further includes a sheet envelope 44 having an opening end flap 33 to permit insertion and removal of mattress 12. A pair of tuck flaps 37 and 39 are further provided at the opposite ends of sheet envelope 44 adapted to be tucked under the regular mattress 14 at opposite ends thereof in order to secure mattress assembly 10 thereto and to prevent relative motion between mattress assembly 10 and bed 16. Sheet envelope 44 may be formed by taking two conventional sheets and seaming them together along seam line 51 and then fashioning flaps 33, 37, 39 and 46. Sheet envelope 44 is provided with a side flap 46 which permits slideable removal of mattress insert 42 to allow the attendant to reach through slot 30 and slideably remove bowl 20 from its seated position. Sheet 44 is provided with a circular cut-out 48 having a reinforced border 49 located so as to register with bowl screen 35 when sheet 44 is wrapped around mattress 12 with mattress assembly 10 in the assembled condition.

In use, with sheet 44 removed, bowl 20 is seated in liner 28 so that bowl lip 32 overlies liner shoulder 29. Mattress insert 42 is placed in rectangular slot 30 and in order to prevent separation of the sidewalls 50 of insert 42 from the sidewalls 52 of slot 30 under the weight of the patient, a pair of strips 54 of fibrous gripping material is secured to the top surface of mattress 12 alongside slot sidewalls 52 for gripping engagement with a matching pair of gripping strips 56 secured at the top edges of insert sidewalls 50. The reinforced circular border 49 of sheet cut-out 48 is then pressed downwardly to grip the top surface of Velcro strip 38 continuously along its entire length to prevent unwanted separation of sheet 44 from bowl lip 32 when mattress assembly 10 is in use.

In use, urine discharged from the bed occupant while in the supine position will drain through bowl screen 35 and will collect in bowl 20. The absorbent material 40 will prevent spillage of the accumulated fluid in bowl 20 due to movement of the patient in the bed 16. Moreover, bowl 20 will be secured seated in mattress cut-out portion 22 against unwanted movement of bowl 20 relative thereto because the reinforced circular border 49 is in continuous gripping engagement with Velcro strips 38 on the inner rim of bowl lip 32. Liner 26 and the secure attachment of insert 42 in mattress slot 30 further serve to stabilize bowl 20 in the seated condition.

When bowl 20 requires removal due to the accumulation of fluid therein from washing or urine discharge or both, the attendant lifts sheet flap 46 and separates Velcro strips 56 from strips 54 and pulls out mattress insert 42 thereby providing access to bowl 20. The attendant then separates sheet border 49 from annular Velcro strip 38 or bowl lip 32 and slideably removes bowl 20 through mattress slot 30. The just-described bowl removal operation may be accomplished with a minimum of disturbance or inconvenience to the patient and does not require removal of the patient from the bed. The used bowl 32 may be appropriately discarded. The attendent then slideably inserts a fresh bowl 20 through mattress slot 30 until it seats in liner 28. Insert 42 is then placed in slot 30 and secured therein as described above. Sheet border 49 is then pressed into gripping engagement with Velcro strip 38 on bowl lip 32 and sheet flap 46 is then tucked under mattress 12 to complete the bowl changing operation. Again, the insertion of a fresh bowl 20 may be accomplished without the necessity of removal of the patient from the bed and with minimal disturbance to the patient.

If desired for added security of attachment of sheet border 49 to bowl lip 32, the underside of sheet border 49 may be provided with an annular matching strip 60 of Velcro material for gripping engagement with strip 38 on bowl lip 32 as shown in FIG. 6.

Bowl 20 including screen 35, strip 38 and absorbent material may be manufactured very inexpensively thus permitting bowl 20 to be disposable, i.e. discarded after accumulation of fluid therein. Such disposability greatly reduces the amount of time required by the attendant to carry out the patient washing operation and changing the bed linens. Due to the ever increasing labor costs involved in the care of bed-ridden patients, including provision and removal of bed pans, the substantial reduction in the amount of time and effort to carry out such tasks made possible by the present invention provides significant savings in costs. Furthermore, since the use of the present invention substantially reduces the necessity of the disagreeable task of changing bed linens soiled by body wastes, improvement in the morale of the attendants is also achieved.

It is understood that if desired, screen 35 may be removably mounted on the lip 32 of bowl 20 to permit removal of the accumulated fluid and wastes followed by cleansing of bowl 20 and reuse thereof. In such embodiment, bowl 20, with absorbent material 40 removed, may be filled with water and used to administer a bed bath. Alternatively, empty bowl 20 may be used as a conventional bedpan. It is understood that in such applications, bowl 20 should have an opening of reduced size in order to prevent the patient's buttocks from sinking into the bowl 20.

In yet another embodiment of the present invention not illustrated in the drawings, screen 35 may be permanently secured to sheet border 49. In a further embodiment of the present invention, bowl 20 may have a shape other than one with a circular opening as shown in FIGS. 1 and 2. Thus, by way of example only, bowl 20 may have a rectangular opening 62 as shown in FIG. 5, it being understood that sheet opening 48 and screen 35 will be correspondingly shaped and sized to match the bowl opening.

While the invention has been particularly shown and described with reference to preferred embodiments, it will be understood by those skilled in the art that changes in form and details some of which may have been described, may be made without departing from the spirit and scope of the invention.

What is claimed is:

1. A mattress assembly for use in connection with a bed provided with a preexisting mattress, comprising: a receptacle having a top opening for receiving fluids from the body of a bed occupant and screen means fixedly secured to said receptacle over the top opening thereof, a mattress having a recess for receiving said receptacle therein, sheet means for wrapping said mattress having an opening therein for registry with said receptacle top opening to permit the flow of fluids through said sheet opening into said receptacle, and a pair of tuck flaps at opposite ends of said sheet means adapted to be tucked under said preexisting mattress, said mattress including a lateral access slot extending from said recess to one side of said mattress to permit slideable withdrawal and insertion of said receptacle from and into said recess without removing said sheet means from said mattress, and an insert removably receivable in said access slot whereby insertion of said insert in said access slot fills the latter and provides a substantially continuous flat upper surface thereover, the opposite sidewalls of said insert being substantially coextensive with the sidewalls of said access slot when said insert is inserted in said access slot, and means for releasably securing the periphery of said sheet opening to the rim of said receptacle defining said receptacle top opening comprising fibrous gripping material and means for releasably securing each of said insert sidewalls to the adjacent access slot sidewalls respectively comprising fibrous gripping material.

2. A mattress assembly as defined in claim 1 wherein said receptacle comprises a hemispherical bowl.

3. A mattress assembly as defined in claim 1 wherein said receptacle comprises a substantially rectangular bowl.

4. A mattress assembly as defined in claim 1 wherein said means for releasably securing said sheet opening to said receptacle rim comprises an annular strip of said fibrous gripping material secured to the rim of said receptacle with the gripping surface thereof facing upwardly to the underside of said sheet means.

5. A mattress assembly as defined in claim 1 wherein said means for releasably securing said insert sidewalls to the adjacent access slot sidewalls comprises a first pair of longitudinal strips of fibrous gripping material secured to the top surface of said mattress alongside said slot sidewalls and a second matching pair of longitudinal strips of fibrous gripping material secured to the top edges of the insert sidewalls.

6. A mattress assembly as defined in claim 1 including fluid absorbing material disposed in said receptacle.

7. A mattress assembly as defined in claim 1 wherein said mattress and said insert comprise cellular foam material.

* * * * *